US009336657B2

(12) United States Patent
Rudd et al.

(10) Patent No.: US 9,336,657 B2
(45) Date of Patent: May 10, 2016

(54) SIDE BET OPTION FOR BLACKJACK

(71) Applicants: Clarence Ernest Rudd, Robina (AU); Kelvin Robert Macbeth, Sinnamon Park (AU)

(72) Inventors: Clarence Ernest Rudd, Robina (AU); Kelvin Robert Macbeth, Sinnamon Park (AU)

(73) Assignee: Blackpot Pty Ltd., Queensland (AU)

( * ) Notice: Subject to any disclaimer, the term of this patent is extended or adjusted under 35 U.S.C. 154(b) by 60 days.

(21) Appl. No.: 14/188,361

(22) Filed: Feb. 24, 2014

(65) Prior Publication Data

US 2014/0248932 A1 Sep. 4, 2014

Related U.S. Application Data

(60) Provisional application No. 61/771,410, filed on Mar. 1, 2013.

(51) Int. Cl.
*G07F 17/32* (2006.01)

(52) U.S. Cl.
CPC ..... *G07F 17/3293* (2013.01); *G07F 17/326* (2013.01)

(58) Field of Classification Search
USPC ..... 463/10, 12, 13; 273/292
See application file for complete search history.

(56) References Cited

U.S. PATENT DOCUMENTS

| | | | | |
|---|---|---|---|---|
| 5,839,730 | A * | 11/1998 | Pike | 273/292 |
| 2006/0131809 | A1* | 6/2006 | Lancaster et al. | 273/292 |
| 2010/0252997 | A1* | 10/2010 | Walker et al. | 273/292 |

OTHER PUBLICATIONS

"Lucky Lucky" Blackjack Side Bet Pay Table, <http://wizardofodds.com/games/blackjack/appendix/8/#luckylucky>.

* cited by examiner

*Primary Examiner* — Paul A D'Agostino
*Assistant Examiner* — Brandon Gray
(74) *Attorney, Agent, or Firm* — Patent Law Group LLP; Brian D. Ogonowsky

(57) ABSTRACT

In additional to a conventional bet in Blackjack, the player also may make a side bet. The game may be played on a video gaming machine or on-line. For the side bet game, if the player obtained the card combination of either 6:7, 6:8, or 7:8, in any order and any suit, on the two cards initially dealt, the player wins 10 times the side bet. The Blackjack game then continues in the normal manner until completed. If the player receives 6:7:8 with three cards, the player also wins an enhanced prize for the side bet. If, in the next Blackjack game, the player also obtains either 6:7, 6:8, or 7:8, an enhance side bet prize is awarded.

14 Claims, 4 Drawing Sheets

SIDE BET OPTION FOR BLACKJACK

CROSS-REFERENCE TO RELATED APPLICATIONS

This application relates to and claims priority from U.S. Provisional Application Ser. No. 61/771,410, filed on Mar. 1, 2013, by the present inventors.

FIELD OF THE INVENTION

This invention relates to the game of Blackjack, which may be played on a dedicated video gaming machine, or via the internet, or using standard playing cards, and, in particular, to a side bet option in such a game.

BACKGROUND

Blackjack is one of the most popular card games played on-line or in casinos. In the conventional game of Blackjack, each player receives two cards face up after wagering. The dealer gets one card down and one card face up. The players may choose to take more cards or stay with the two original cards dealt. Once all players have made their decisions, the dealer may take another card. The dealer will draw cards in accordance with the house rules, usually being that the dealer has to draw cards until the sum of the cards is at least seventeen. The player wins the wagered amount if the sum of the player's cards is closer to 21 than the sum of the dealer's cards, without going over.

If, on the initial deal, the dealer has an ace or a ten card (a face card or a ten) face up, then the hole card is checked by the dealer. If it completes a Blackjack (equals 21), then the dealer wins and the game is over. A tie is a push.

The full official rules of Blackjack are incorporated herein.

If the Blackjack game is played on a dedicated video gaming machine in a licensed establishment or played on-line using a general purpose computer, such as a smartphone or other computer, the rules are exactly the same but typically there is only one player playing against a programmed "dealer."

For more excitement, it would be desirable to provide additional betting possibilities for the Blackjack game.

A side bet for Blackjack is known and is called "Lucky Lucky." A complete pay table for the side bet is found at the web site http://wizardofodds.com/games/blackjack/appendix/8/. The most pertinent Lucky Lucky side bet is for the card combination of 6, 7, and 8, in any suit, using the player's two dealt cards and the up card of the dealer. This pays 30 times the side bet.

This is not a good concept for a side bet since it is too rare an occasion (a probability of 0.002585), and relies on the dealer's up card. In order to make the side bet more attractive to the player, the Lucky Lucky pay table adds seven more possibilities for winning the side bet game, using different combinations of cards from the player's two cards and the dealer's up card. There is even another winning combination of 6, 7, and 8 using the player's and dealer's cards where the combination has to be in the same suit. Each combination has a different pay out. This makes the side bet game complicated and detracts from the momentum of the game since some of the winning combinations occur frequently and only pay double the side bet. The side bet is usually lower than the wager for the Blackjack game.

Therefore, what is needed is a variation on such a side bet game that is optimally designed to be simple, has a reasonable expectation of occurring, does not detract from the main game, is profitable to the "house", and still pays an amount that entices the player to make the side bet.

SUMMARY

The invention applies to a casino Blackjack game with physical playing cards or a Blackjack game played on a computer having a display screen.

A side bet option allows the player to wager a side bet in addition to the regular Blackjack bet. If actual or virtual chips are used, the side bet chips are placed in a designated location near the player position to avoid the side bet mixing with the regular bet. If the player receives either 6:7 or 6:8 or 7:8, in any order or suit, with the first two cards dealt to the player, the player instantly wins a multiple of the side bet (e.g., 10 times). Since the side bet game is independent from the regular Blackjack game and essentially rewards players for obtaining the worst combinations of cards, there should be no reluctance to augment any Blackjack game with the present invention. Since the augmented game is more interesting to the player, additional revenues will be received by the gaming establishment.

The side bet combination is the only way to win the side bet game so is very simple to understand and does not significantly delay the main game. The probability of winning the side bet game with the first two cards dealt is slightly less than 1 in 10, so an instant payout of 10 times the side bet is reasonable and entices the player to make the side bet. Further, since the side bet is only based on the player's own cards, the player fate is completely independent of the dealer's cards and becomes less adversarial.

Additionally, if the player then elects to receive a third card and achieves a 6:7:8 in any order and any suit, the player wins an instant enhanced prize, such as 100 times the side bet. Accordingly, the player is additionally motivated to take the third card even though there is a chance that the player may bust. This changes the strategy of the game and makes it more interesting.

If, in the very next game, the player again receives either 6:7 or 6:8 or 7:8 with the first two cards dealt, a greatly enhanced side bet award is granted.

DETAILED DESCRIPTION

A side bet option for a conventional Blackjack game is described for a physical card game, or a game played on a dedicated video gaming machine, or a game played on-line using a general purpose computer.

Figure 1:
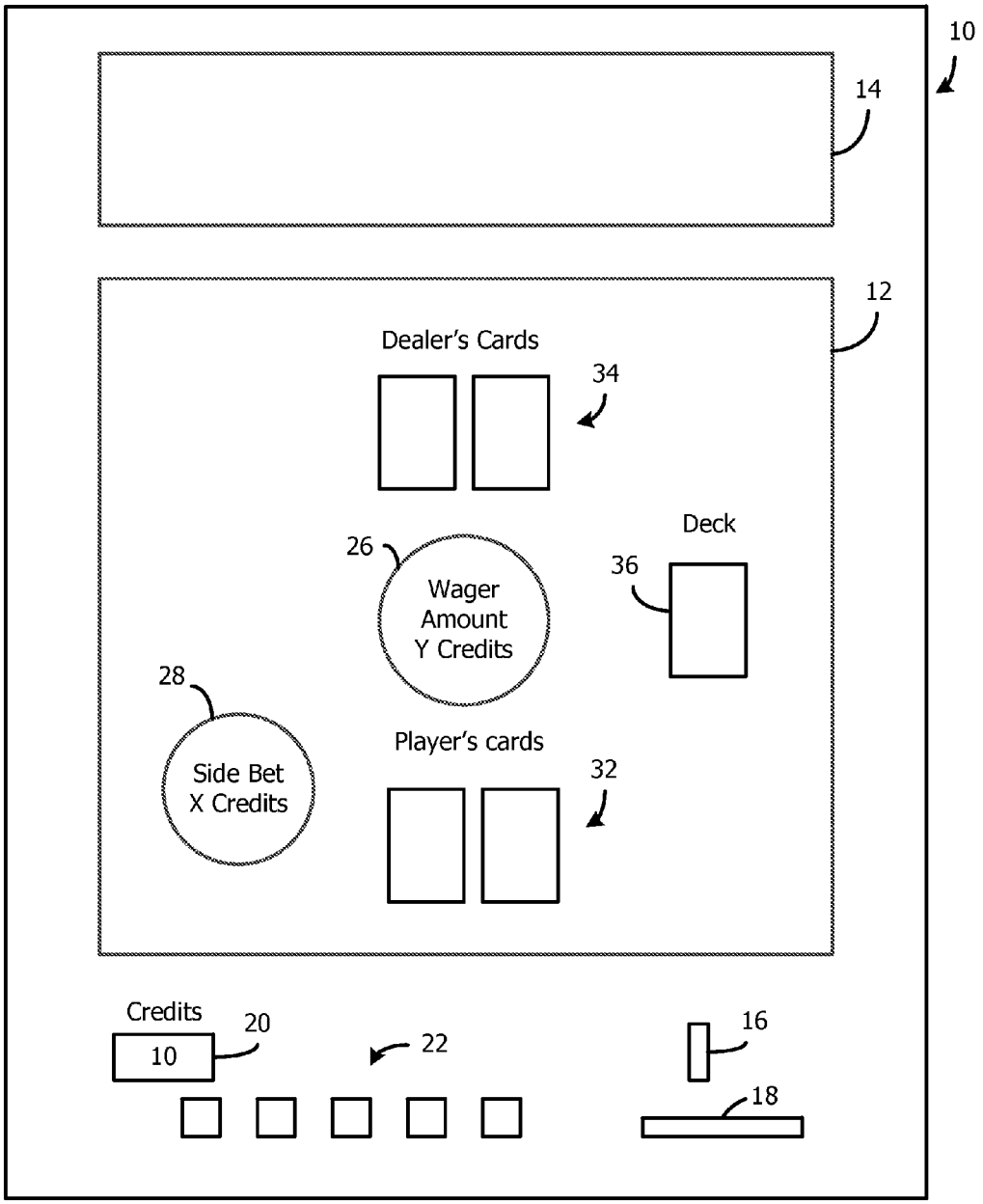
FIG. 1 is a front view of a gaming machine displaying a Blackjack game with the side bet option in accordance with the invention.

FIG. 1 illustrates an electronic gaming machine 10 (a console) having at least a main video display screen 12 on which is displayed the inventive Blackjack game. A secondary screen 14 may display the game title, pay tables, a secondary game, or any other information.

The machine 10 may have a coin/token slot 16 for validating coins/tokens to create a bank of credits. The machine 10 has at least one slot 18 for reading credit codes on coupons, or validating bills, or dispensing printed coupons upon the player cashing out, or reading a player tracking card. A credit meter 20, which may be part of the screen 12, identifies the amount of credits stored in the machine 10. Player control buttons 22 allow the player to make wagers, initiate the game, and make other selections. The buttons 22 may be touch screen buttons on the screen 12.

The game shown on the screen 12 is a single-player game but, for a game played at a card table or on-line, the game may be played by multiple players against a single physical or virtual dealer.

Figure 2:
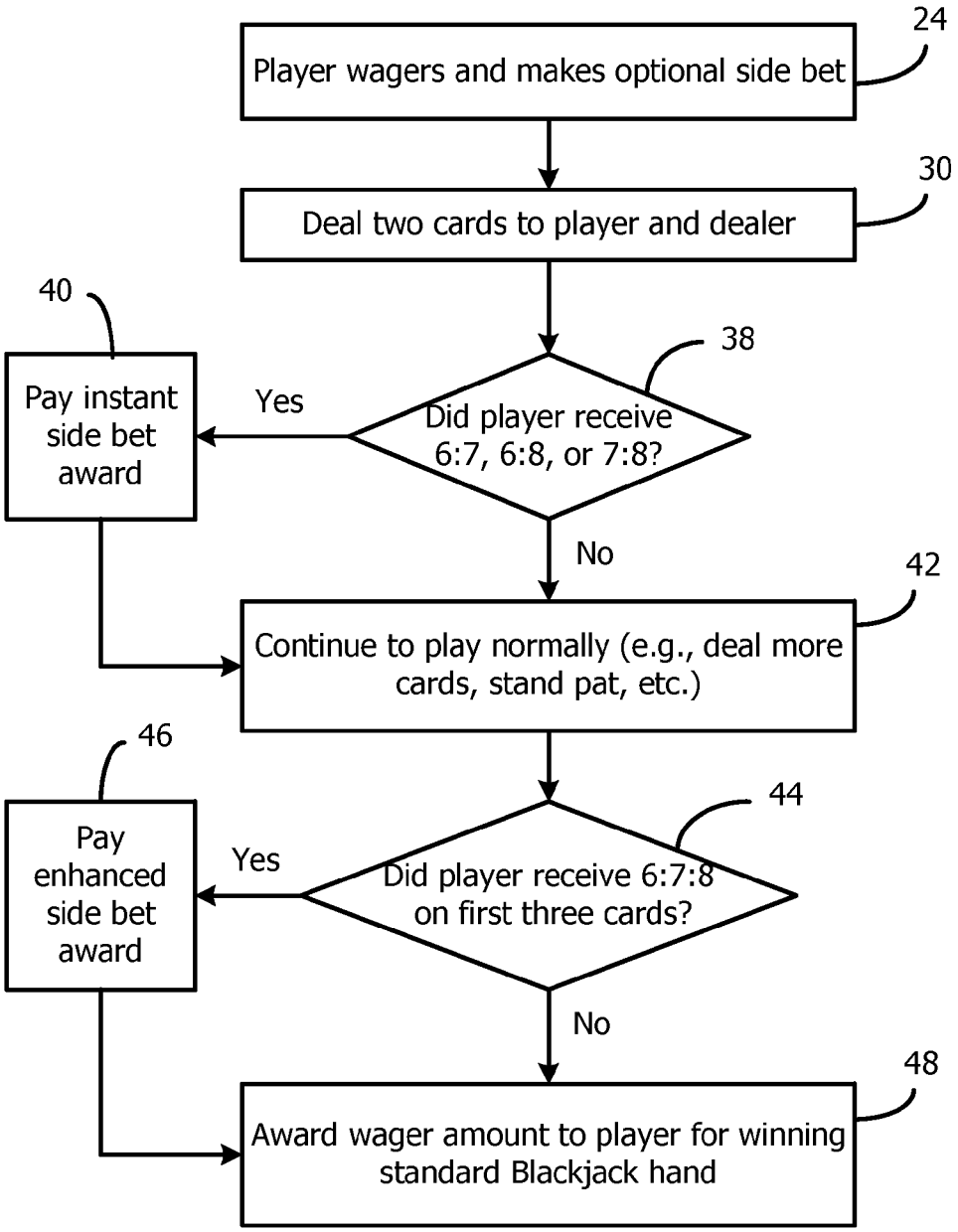
FIG. 2 is a flowchart showing various steps for playing the Blackjack game and side bet game in accordance with the invention.

The game played on the machine 10 is described with respect to the flowchart of FIG. 2.

In step 24, the player makes a wager on the Blackjack hand (the main game) by pressing suitable buttons 22, which may be touch screen buttons. This wager is then displayed in the area 26 on the screen 12 and may resemble chips.

The player may also make a side bet, which may be less than the minimum bet for the wager on the main game. This side bet is then displayed in the area 28 on the screen 12 and may resemble chips. The side bet is completely independent of the wager. All bets and awards are in credits.

In step 30, the virtual dealer deals two up cards 32 to the player and two cards 34 to the dealer, where one of the dealer's cards is face up and the other is face down. The remainder of the virtual deck 36 is also shown. A random number generator determines the cards dealt.

In step 38, it is determined by the processor in the machine 10 whether the player received a card combination, in any suit, of either 6:7 or 6:8 or 7:8. If the combination is present and if the player made the side bet, the player is instantly awarded 10 times the side bet (step 40). This still makes money for the house since the probability of winning the side bet is less than 1 in 10. If the game is an actual card game, the player may be awarded the physical chips at the end of the Blackjack game to avoid any delay in the game.

This winning combination of cards is selected because the sums of 13-15 are generally the worst sums to receive due the high probability that the dealer will achieve a higher sum and the medium probability that the player will bust (exceed 21) on the next card. Effectively, winning the side bet is an interim and instant consolation prize.

The player may then request more cards via the user interface or stand pat (step 42). The screen 12 will prompt the player by asking if she wants more cards. The player tries to get as close to 21 without going over. If the player beats the dealer, after the dealer is finished taking cards, the player wins.

If the player is dealt a third card, then, in step 44, the processor in the machine 10 determines whether the player's resultant 3-card hand consists of a 6, 7, and 8 in any order or suit. This is less than a 1 in 100 probability. If so, the player instantly wins 100 times the original side bet (step 46). Additionally, the player has now achieved 21 and has a very good chance of beating the dealer.

Accordingly, the player is additionally motivated to take the third card even though there is a chance that the player may bust. This changes the strategy of the game and makes it more interesting. A reasonable strategy is to always take the extra card due to the potentially high return from the side bet.

The exception to this entitlement of taking a third card is if the dealer turns over a Blackjack (21 with only two cards) with an ace and a ten/face card. The player still wins the 2-card combination award. The game is now over.

Once the main game is over, the determination of a winner is made and the award, if any, is paid to the player. Typically, for a win, the player wins the wagered amount.

The following variation of the side bet game in FIG. 2 is a "two hands in a row" progressive, where the original side bet carries over to the immediate next hand if the player won the 2-card side bet game described in FIG. 2. If the player again wins the side bet game in the subsequent game, the award is dramatically higher (e.g., 1000 times the side bet). Generally, the player wins a multiple of the side bet for a winning occurrence approximately proportional to the odds of that winning occurrence happening. Below is a reasonable pay table showing the side bet win for the initial hand and the hand in the immediate next game. If a winning side bet hand occurs during that next game, that game then becomes the initial hand for the next "two hand in a row" progressive game.

- Initial hand of 2 cards of either 6:7, 6:8, or 7:8, in any order and any suit, pays 10 to 1.
- Complete initial hand with 6, 7, and 8 in any order and suit, pays 100 to 1.
- Immediate next hand (side bet rides) with 2 cards of either 6:7, 6:8, or 7:8, in any order and any suit, pays 1,000 to 1.
- Complete next hand with 6, 7, and 8 in any order and suit, pays 20,000 to 1.

The above odds may be varied according to the operator's choosing; however, the above pay table provides the house a reasonable profit.

As seen, the potential side bet award is extremely high, and players will be motivated to play on gaming machines that include such a feature. The side bet game also changes the strategy when selecting a third card, since the player will make a riskier decision due to the high potential payout.

The award granted for this side bet is completely independent of any award in the underlying conventional Blackjack game.

The side bet option is also applicable to related underlying games, such as PONTOON 21, and other games where the best card sum is 21.

The cards may be dealt from a conventional fifty two card deck, either physical or virtual. The cards are shuffled (randomized) after each game or may be shuffled continuously from an automatic shuffle machine or a virtual shuffle machine.

A further possible option is to pay a running (progressive) jackpot for either a complete 6:7:8 in that order or 6:7:8 in any order but of the same suit. The progressive jackpot may be incremented from a percentage of all wagers or just the side bets.

Figure 3:
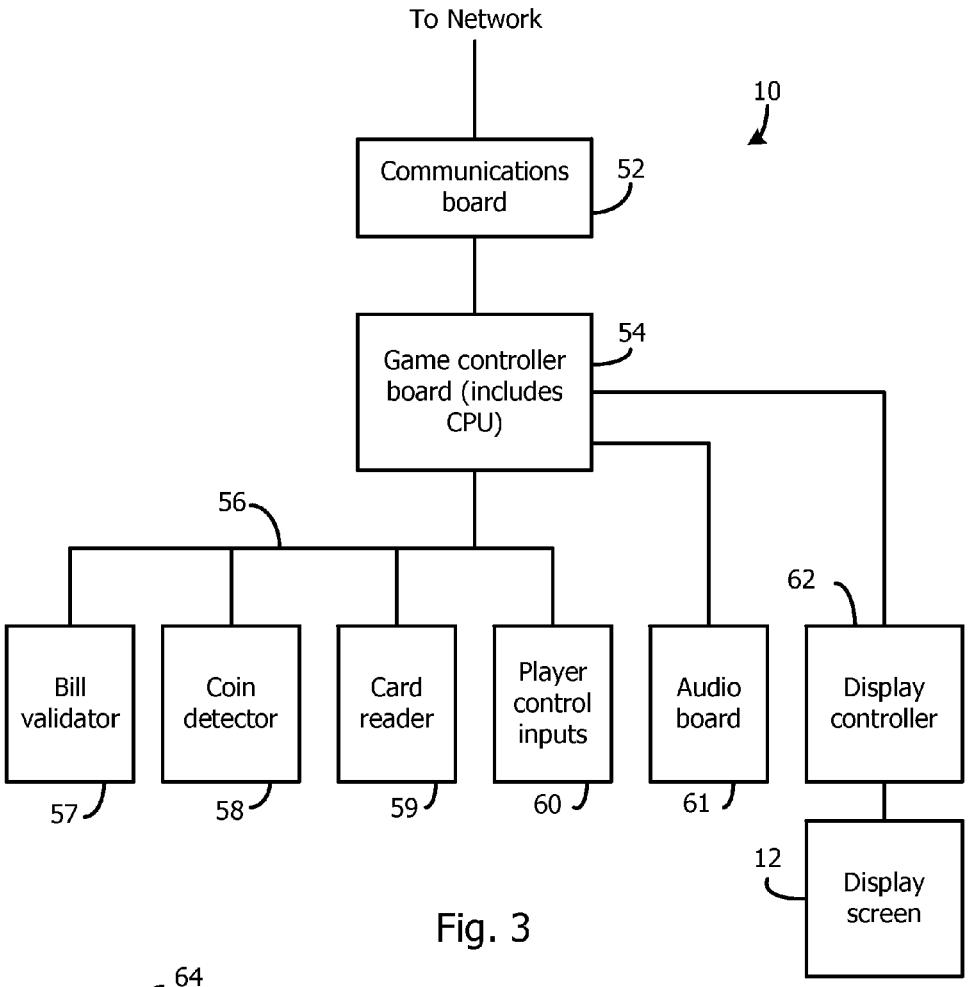
FIG. 3 illustrates various functional hardware circuits in a gaming machine, where the machine is programmed to carry out the present invention.

FIG. 3 is a diagram of the electronic functional units in the gaming machine 10, in accordance with one embodiment of the invention. The gaming system may use conventional hardware, and the software defines the game.

A communications board 52 may contain conventional circuitry for coupling the gaming machine 10 to a local area network (LAN) or other type of network using any suitable protocol. The gaming machine 10 may thus be monitored and programmed remotely, and the players' credits may be stored in a central system memory.

A game controller board 54 contains memory and a processor system for carrying out game programs stored in the memory and for providing the information requested by the network. The game controller board 54 primarily carries out the game routines.

Peripheral devices/boards communicate with the game controller board 54 via a bus 56 using, for example, an RS-232 interface. Such peripherals may include a bill validator 57, a coin detector 58, a player tracking card or other card reader 59, and player control inputs 60 (such as touch screen inputs). Payment may be by printed ticket, cash, electronic transfer or other means. An audio board 61 converts coded signals into analog signals for driving speakers. A display controller 62 converts coded signals to pixel signals for the display screen 12.

The electronics on the various boards may be combined onto a single board.

Figure 4:
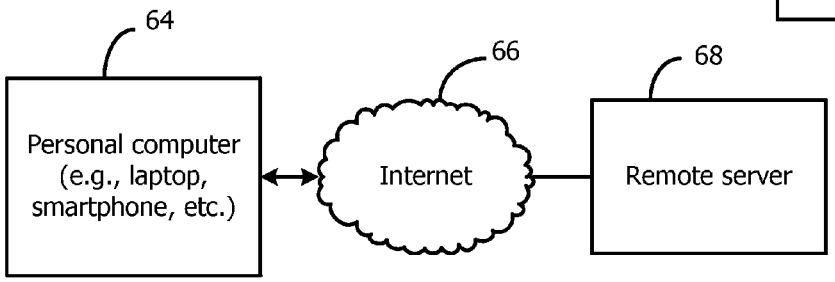
FIG. 4 illustrates the use of a personal computing device that can be programmed to carry out the invention when connected on-line with a remote server.

FIG. 4 illustrates that the above-described game may be performed on any computing device 64 connected to the internet 66. A remote server 68 makes all the game decisions, and the computing device 64 essentially acts as a user interface to display the game and receive selection information from the player. The computing device 64 may be a suitable generic computer or mobile computing device (smartphone, tablet, etc.) connected to a network/server via the internet and programmed to carry out the inventive methods. The gaming machine 10 of FIG. 1 may itself be a screen image in a virtual casino. Icon selection may be by touch screen, a mouse, a joystick, or other means. For gaming via the internet, the wagering would typically be by credit card or accessing an existing account. Awarding the player may be by crediting the player's account. All such computing devices, when programmed for gaming, are considered a gaming machine.

Figure 5:
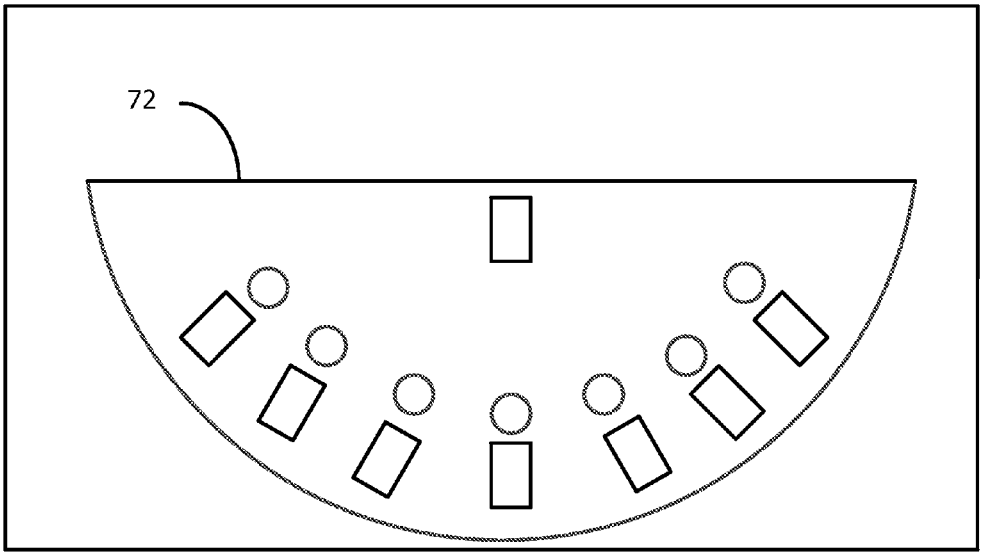
FIG. 5 illustrates a physical or virtual card table, having side bet areas, that can be used when playing the game incorporating the present invention.

FIG. 5 illustrates a physical card table 72 for up to seven players, or the table 72 may be displayed on a screen as a virtual table to make the game more realistic. Multiple players may play on-line via the same remote server 68 (FIG. 4). A routine may be carried out showing the dealing of cards, etc. The players may make a main bet by placing actual or virtual chips in an area in front of them, and place a side bet by placing chips next to the rectangular card area in front of each player.

The game of the present invention provides a method of side betting which is interesting to the players without being unduly complicated, does not interfere with the main game, changes the strategy of the game, and provides the players with a reasonable expectation of success whilst maintaining an acceptable house advantage. The side bet game provides synergy since the conventional game can be played unaffected, yet an additional game is played that benefits the players and the house.

Those skilled in the art may write the appropriate software to carry out the invention without undue experimentation. The hardware used may be conventional.

Accordingly, while particular embodiments of the present invention have been shown and described, it will be obvious to those skilled in the art that changes and modifications may be made without departing from this invention in its broader aspects and, therefore, the appended claims are to encompass within their scope all such changes and modifications that are within the true spirit and scope of this invention.

What is claimed is:

1. A gaming device comprising:

an opening in the gaming device configured to receive and detect an object inserted into it representing a monetary amount for establishing credits for wagering by the player;

a display screen displaying a game; and a programmed processing system, the processing system being programmed to carry out the method comprising:

detecting a wager for a Blackjack game and a side bet from the player, wherein the wager and the side bet are deducted from the credits;

displaying on the screen, in a first game, two virtual playing cards dealt to the player and two virtual playing cards dealt to a virtual dealer to play the Blackjack game;

determining if the player obtained the card combination of either 6:7, 6:8, or 7:8, in any order and any suit, on the two cards dealt;

awarding the player a first prize for obtaining the combination of either 6:7, 6:8, or 7:8 with the first two cards dealt, as a result of the player making the side bet;

continuing to play the Blackjack game irrespective of awarding the player the prize;

upon the player electing to be dealt a third card, determining if the player obtained the card combination of 6:7:8, in any order and any suit, on the three cards dealt;

awarding the player a second prize for obtaining the combination of 6:7:8 with the first three cards dealt, as a result of the player making the side bet;

awarding the player another prize, if any, based on the wager for winning at the Blackjack game; and if the player obtained the card combination of 6:7:8 on the three cards dealt in the first game, and if the player again obtained the card combination of either 6:7, 6:8, or 7:8, in any order and any suit, on two cards dealt in the very next Blackjack game, then awarding the player an enhanced third prize, where the third prize is greater than the first prize.

2. The device of claim 1 wherein the step of awarding the player a prize for obtaining the combination of either 6:7, 6:8, or 7:8 with the first two cards dealt occurs prior to the dealer or the player requesting an additional card.

3. The device of claim 1 wherein the processing system is further programmed to pay a progressive jackpot if the player was dealt either 6:7:8 in that order or 6:7:8 in any order but of the same suit in the next Blackjack game.

4. The device of claim 1 wherein the gaming device comprises a dedicated gaming console in a licensed gaming establishment.

5. The device of claim 1 wherein the gaming device comprises a programmed computer connected to a server via the Internet.

6. The device of claim 5 wherein the steps of determining and awarding are carried out by the server.

7. A method for playing Blackjack on a computing device, including a display screen, comprising:

receiving an object inserted into an opening in the computing device representing a monetary amount for establishing credits for wagering by the player;

displaying on the screen, under control of a processing system, a wager for a Blackjack game and a side bet from the player, wherein the wager and the side bet are deducted from the credits;

displaying on the screen in a first game, under control of the processing system, two virtual playing cards dealt to the player and two virtual playing cards dealt to a virtual dealer to play Blackjack;

displaying on the screen, under control of the processing system, a first prize awarded to the player for obtaining the card combination of either 6:7, 6:8, or 7:8, in any order and any suit, on the two cards dealt, as a result of the player making the side bet;

continuing to play Blackjack irrespective of awarding the player the prize;

upon the player electing to be dealt a third card, determining if the player obtained the card combination of 6:7:8, in any order and any suit, on the three cards dealt;

awarding the player a second prize for obtaining the combination of 6:7:8 with the first three cards dealt, as a result of the player making the side bet;

displaying on the screen, under control of the processing system, another prize awarded to the player, if any, based on the wager for winning at Blackjack; and if the player obtained the card combination of 6:7:8 on the three cards dealt in the first game, and if the player again obtained the card combination of either 6:7, 6:8, or 7:8, in any order and any suit, on two cards dealt in the very next Blackjack game, then awarding the player an enhanced third prize, where the third prize is greater than the first prize.

8. The method of claim 7 wherein the step of displaying a prize for obtaining the combination of either 6:7, 6:8, or 7:8 with the first two cards dealt occurs prior to the dealer or the player requesting an additional card.

9. The method of claim 7 further comprising awarding, under control of the processing system, a progressive jackpot if the player was dealt either 6:7:8 in that order or 6:7:8 in any order but of the same suit in the next Blackjack game.

10. The method of claim 7 wherein the computing device comprises a dedicated gaming console in a licensed gaming establishment.

11. The method of claim 7 wherein the computing device comprises a programmed computer connected to a server via the Internet.

12. The method of claim 11 wherein game decisions are carried out by the server.

13. The method of claim 7 further comprising awarding, under control of the processing system, an award if the player was dealt 6:7:8 in any order or any suits in the next Blackjack game.

14. The device of claim 1 wherein the processing system is further programmed to pay an award if the player was dealt 6:7:8 in any order or any suits in the next Blackjack game.

* * * * *